US012163266B2

(12) United States Patent
Chung et al.

(10) Patent No.: US 12,163,266 B2
(45) Date of Patent: Dec. 10, 2024

(54) LAUNDRY TREATMENT APPLIANCE AND METHOD OF USING THE SAME ACCORDING TO INDIVIDUAL LAUNDRY LOAD WEIGHTS

(71) Applicant: Haier US Appliance Solutions, Inc., Wilmington, DE (US)

(72) Inventors: Myunggeon Chung, Seoul (KR); Jee Eun Oh, Gyeonggi (KR); Jongdeok Jang, Gyeonggi (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 236 days.

(21) Appl. No.: 17/836,436

(22) Filed: Jun. 9, 2022

(65) Prior Publication Data

US 2023/0399784 A1 Dec. 14, 2023

(51) Int. Cl.
*D06F 33/36* (2020.01)
*D06F 34/18* (2020.01)

(52) U.S. Cl.
CPC ..... *D06F 33/36* (2020.02); *D06F 34/18* (2020.02)

(58) Field of Classification Search
CPC ..... D06F 34/05; D06F 34/18; D06F 33/30; D06F 33/46; D06F 33/70; D06F 33/72; D06F 2103/00–06
See application file for complete search history.

(56) References Cited

U.S. PATENT DOCUMENTS

| | | | | |
|---|---|---|---|---|
| 10,121,287 | B2 | 11/2018 | Amin | |
| 10,466,665 | B2 | 11/2019 | Belveal et al. | |
| 2014/0085046 | A1* | 3/2014 | Shin | D06F 34/05 68/12.26 |
| 2017/0082991 | A1* | 3/2017 | Belveal | D06F 39/00 |
| 2017/0083885 | A1 | 3/2017 | Khadgi | |
| 2020/0199800 | A1* | 6/2020 | Han | D06F 33/00 |

FOREIGN PATENT DOCUMENTS

| | | | |
|---|---|---|---|
| CN | 107967643 | A | 4/2018 |
| WO | WO2018077055 | A1 | 5/2018 |

* cited by examiner

*Primary Examiner* — Spencer E. Bell
*Assistant Examiner* — Omair Chaudhri
(74) *Attorney, Agent, or Firm* — Dority & Manning, P.A.

(57) ABSTRACT

A laundry treatment appliance includes a cabinet, a wash tub, a wash basket, and a controller, the controller being configured to direct a laundry operation. The laundry operation includes receiving wash requests from a plurality of unique users, wherein each of the wash requests includes a unique laundry load weight provided by each unique user of the plurality of unique users, matching a first unique user and a second unique user from the plurality of users, the first user having a first unique laundry load weight and the second user having a second unique laundry load weight, determining a first individual cost for the first unique user and a second individual cost for the second unique user in response to confirming the first and second unique laundry load weights, and generating a joint washing cycle.

20 Claims, 4 Drawing Sheets

LAUNDRY TREATMENT APPLIANCE AND METHOD OF USING THE SAME ACCORDING TO INDIVIDUAL LAUNDRY LOAD WEIGHTS

FIELD OF THE INVENTION

The present subject matter relates generally to laundry treatment appliances, and more particularly to commercial laundry treatment appliances capable of receiving multiple users' laundry.

BACKGROUND OF THE INVENTION

Conventional laundry treatment appliances typically include a wash tub for holding water and a wash basket rotatably provided within the wash tub. Articles to be washed, such as clothing, bedding, towels, and the like, are placed within the wash basket where water and detergent are supplied to perform a washing operation. Some users of laundry treatment appliances utilize large scale facilities, such as public laundromats. These laundromats include multiple machines including washing machines and dryers. Each washing (or drying) operation performed within a machine carries a cost. Oftentimes, this cost is a fixed fee, regardless of the size of the load, the amount of water used, and other factors.

In many washing operations, users will separate out articles to be washed into like categories, such as delicates, whites, colors, sheets, and the like. This may result in some washing loads to be lighter or smaller than others. For instance, a single user may only own a few items deemed delicate, which may not be enough to justify running an entire washing operation. For instance, a user may not wish to pay a fee for a full operating cycle of the appliance when only a fraction of its capacity is used. Moreover, energy and resources such as water would be wasted in performing large washing operations with fractional washing loads.

Accordingly, a laundry treatment appliance that obviates one or more of the above-mentioned drawbacks would be beneficial. In particular, a laundry treatment appliance capable of accepting multiple different washing loads and distributing cost evenly would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry treatment appliance is provided. The laundry treatment appliance may include a cabinet defining a receiving space; a wash tub provided within the receiving space; a wash basket received within the wash tub; and a controller provided within the cabinet, the controller being configured to direct a laundry operation. The laundry operation may include receiving wash requests from a plurality of unique users, each of the wash requests including a unique laundry load weight provided by each unique user of the plurality of unique users; matching a first unique user and a second unique user from the plurality of users, the first user having a first unique laundry load weight and the second user having a second unique laundry load weight; confirming the first and second unique laundry load weights within the wash basket; determining a first individual cost for the first unique user and a second individual cost for the second unique user in response to confirming the first and second unique laundry load weights; and generating a joint washing cycle subsequent to confirming the first and second laundry load weights.

In another exemplary aspect of the present disclosure, a method of operating a laundry treatment appliance is provided. The laundry treatment appliance may include a cabinet defining a receiving space, a wash tub provided within the receiving space, and a wash basket received within the wash tub. The method may include receiving wash requests from a plurality of unique users, each of the wash requests including a unique laundry load weight provided by each unique user of the plurality of unique users; matching a first unique user and a second unique user from the plurality of users, the first user having a first unique laundry load weight and the second user having a second unique laundry load weight; confirming the first and second unique laundry load weights within the wash basket; determining a first individual cost for the first unique user and a second individual cost for the second unique user in response to confirming the first and second unique laundry load weights; and generating a joint washing cycle subsequent to confirming the first and second laundry load weights.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
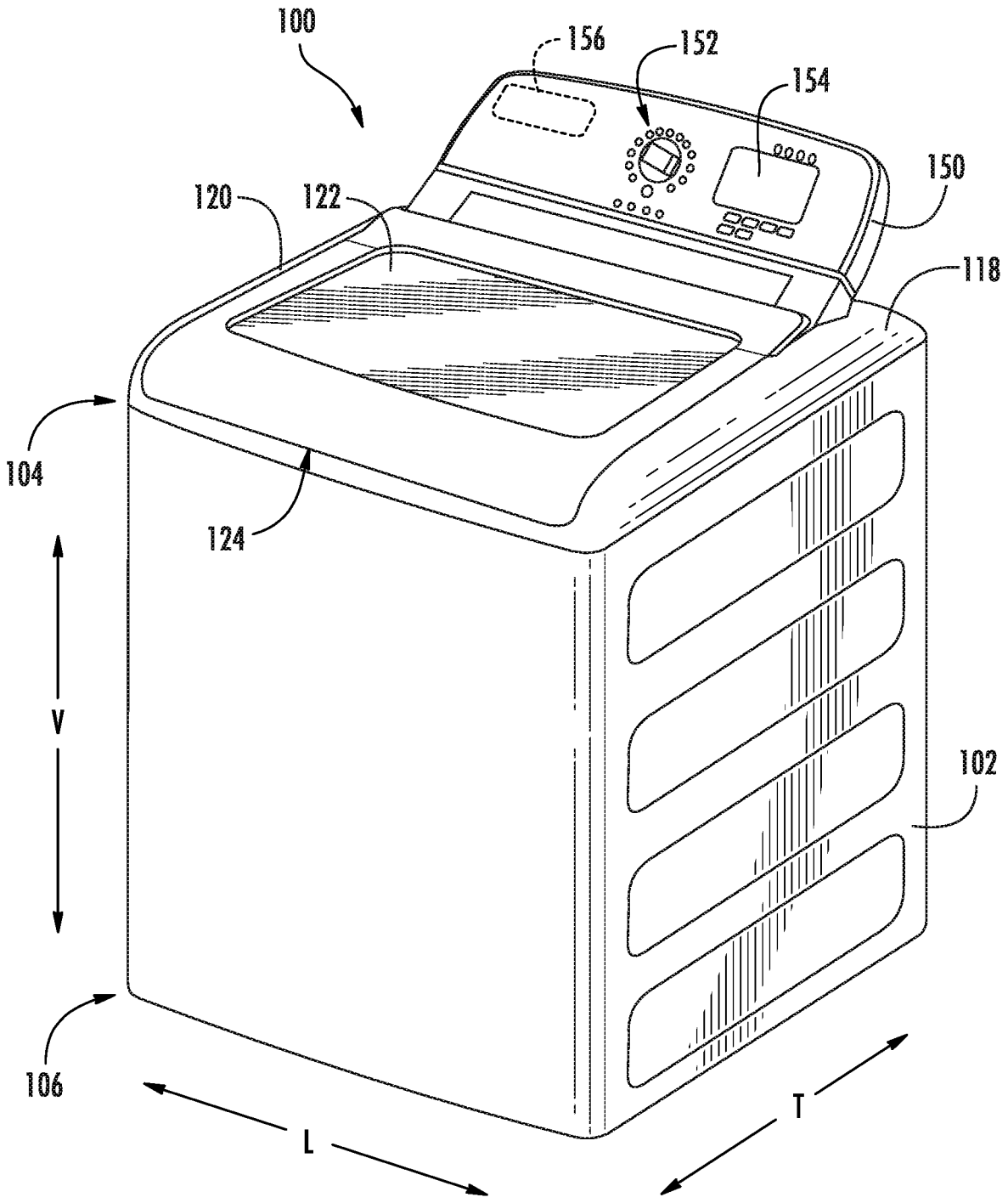
FIG. 1 provides a perspective view of a laundry machine appliance with a lid in a closed position according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
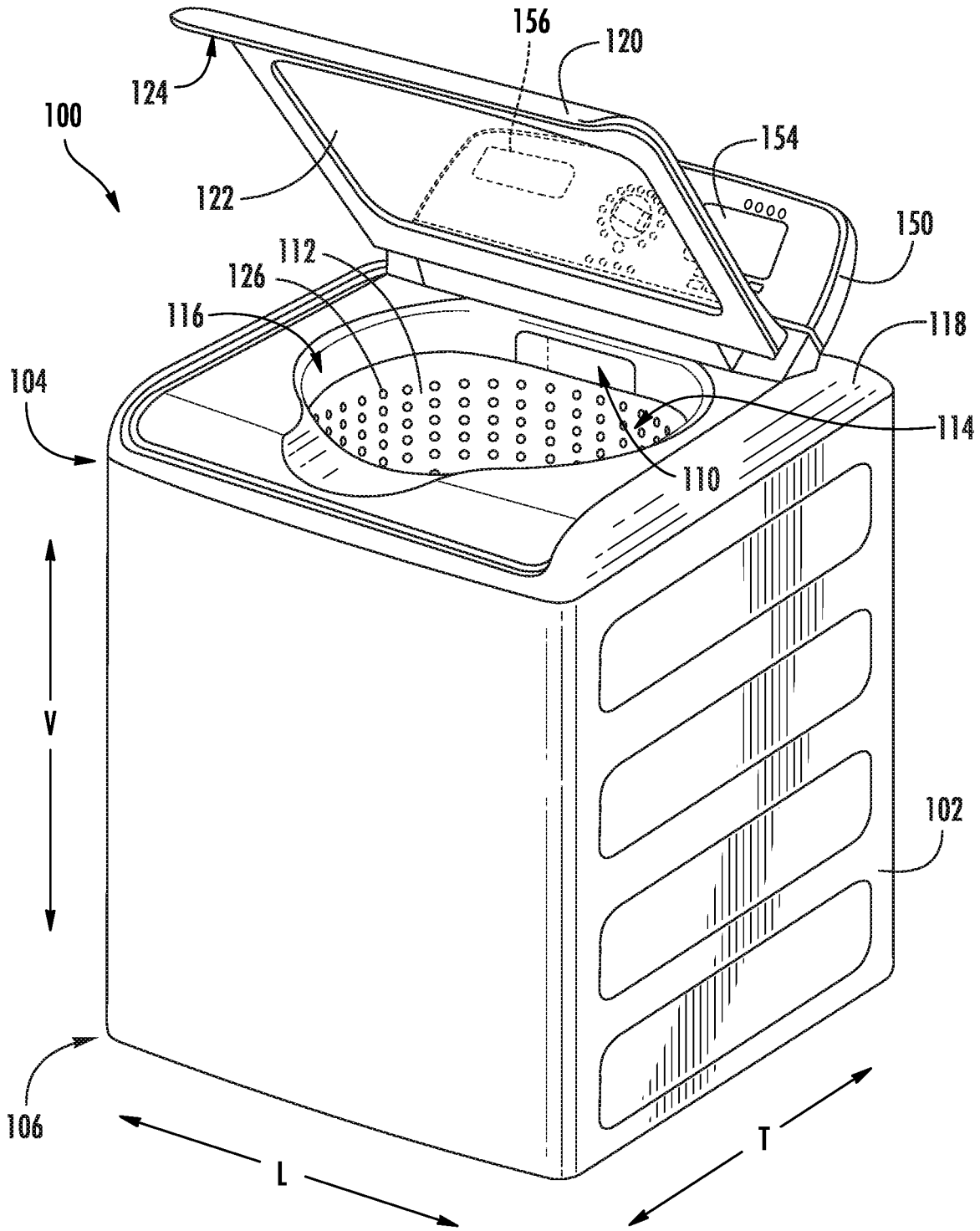
FIG. 2 provides a perspective view of the exemplary laundry machine appliance of FIG. 1 with the lid in an open position.
Figure 3:
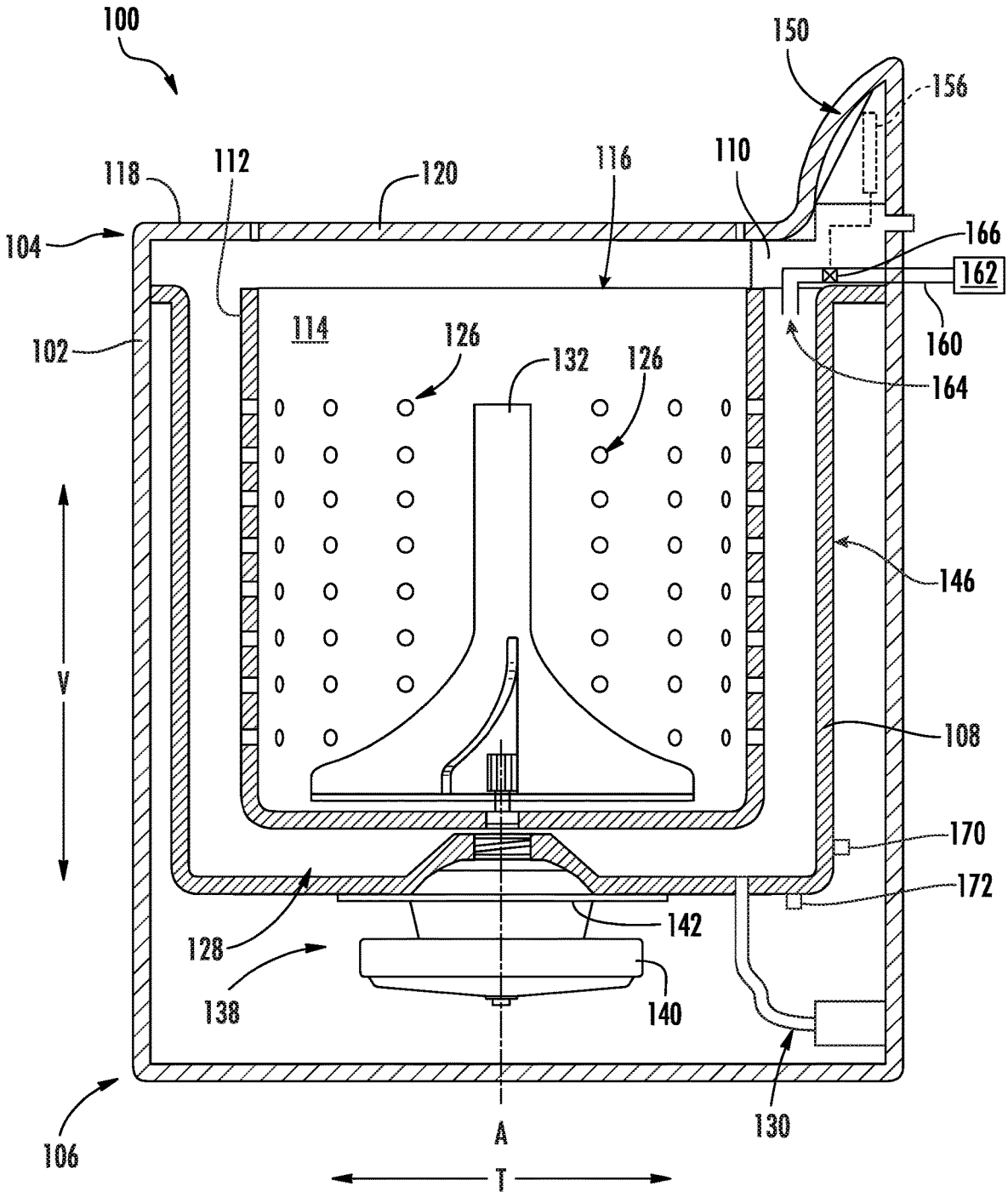
FIG. 3 provides a cut-away side view of the exemplary laundry machine appliance of FIG. 1.

FIGS. 1 through 3 illustrate an exemplary embodiment of a vertical axis laundry machine appliance or laundry treatment appliance (e.g., such as a washing machine) 100. Specifically, FIGS. 1 and 2 illustrate perspective views of laundry machine appliance 100 in a closed and an open position, respectively. FIG. 3 provides a side cross-sectional view of laundry machine appliance 100. Laundry machine appliance 100 generally defines a vertical direction V, a lateral direction L, and a transverse direction T, each of which is mutually perpendicular, such that an orthogonal coordinate system is generally defined.

While described in the context of a specific embodiment of a vertical axis laundry machine, it should be appreciated that vertical axis laundry machine appliance 100 is provided by way of example only. It will be understood that aspects of the present subject matter may be used in any other suitable laundry machine appliance, such as a horizontal axis laundry machine appliance. Indeed, modifications and variations may be made to laundry machine appliance 100, including different configurations, different appearances, and/or different features while remaining within the scope of the present subject matter. For instance, laundry machine appliance 100 may be a combination washing machine and dryer appliance, a stand-alone washing machine, a dryer, or any suitable appliance capable of performing a laundry operation on a laundry load.

Laundry machine appliance 100 has a cabinet 102 that extends between a top portion 104 and a bottom portion 106 along the vertical direction V. As best shown in FIG. 3, a tub 108 is positioned within cabinet 102 and is generally configured for retaining wash fluids during an operating cycle (e.g., a washing cycle). Laundry machine appliance 100 further includes a primary dispenser 110 (FIG. 2) for dispensing wash fluid into tub 108. The term "wash fluid" refers to a liquid used for washing and/or rinsing articles during an operating cycle and may include any combination of water, detergent, fabric softener, bleach, and other wash additives or treatments. Further, it should be noted that primary dispenser 110 is provided by way of example only, and that laundry machine appliance 100 may incorporate any suitable form of detergent dispenser, including manual fill dispensers.

In addition, laundry machine appliance 100 may include one or more removable wash baskets 112 selectively positioned within tub 108 and generally defining one or more wash chambers 114. For instance, an opening 116 may be formed in cabinet 102 for receipt of articles for washing (e.g., for receipt of one or more removable wash baskets). More specifically, wash basket 112 (e.g., one or more) may be rotatably mounted within tub 108 such that it is rotatable about an axis of rotation A. According to the illustrated embodiment, the axis of rotation A is substantially parallel to the vertical direction V. In this regard, laundry machine appliance 100 is generally referred to as a "vertical axis" or "top load" laundry machine appliance 100. However, as noted above, it should be appreciated that aspects of the present subject matter may be used within the context of a horizontal axis or front load laundry machine appliance as well.

As illustrated, cabinet 102 of laundry machine appliance 100 has a top panel 118. Top panel 118 may define opening 116 of to permit a user access to tub 108. Laundry machine appliance 100 may further include a door 120 which is rotatably mounted to top panel 118 to permit selective access to opening 116. In particular, door 120 may selectively rotate between the closed position (as shown in FIGS. 1 and 3) and the open position (as shown in FIG. 2). In the closed position, door 120 inhibits access to tub 108 (and, selectively, one or more wash baskets 112). Conversely, in the open position, a user can access wash basket 112. A window 122 in door 120 may permit viewing of wash basket 112 when door 120 is in the closed position, e.g., during operation of laundry machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 112 further defines a plurality of perforations 126 to facilitate fluid communication between an interior of wash basket 112 and tub 108. In this regard, wash basket 112 is spaced apart from tub 108 to define a space for wash fluid to escape wash chamber 114. During a spin cycle, wash fluid within articles of clothing and within wash chamber 114 is urged through perforations 126 wherein it may collect in a sump 128 defined by tub 108. Laundry machine appliance 100 may further include a pump assembly 130 (FIG. 3) that is located beneath tub 108 and wash basket 112 for gravity assisted flow when draining tub 108, e.g., after a wash or rinse cycle.

An impeller or agitator 132 (FIG. 3), such as a vane agitator, impeller, auger, oscillatory basket mechanism, or some combination thereof may be disposed in wash basket 112 to impart an oscillatory motion to articles and liquid in wash basket 112. More specifically, agitator 132 may extend into wash basket and assists agitation of articles disposed within wash basket 112 during operation of laundry machine appliance 100, e.g., to facilitate improved cleaning. In different embodiments, agitator 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitator 132 and wash basket 112 are oriented to rotate about the axis of rotation A (which is substantially parallel to vertical direction V). The agitator shown in FIG. 3 (agitator 132) is merely an example, and any suitable agitator may be incorporated.

As best illustrated in FIG. 3, laundry machine appliance 100 includes a drive assembly 138 in mechanical communication with wash basket 112 to selectively rotate wash basket 112 (e.g., during an agitation or a rinse cycle of laundry machine appliance 100). In addition, drive assembly 138 may also be in mechanical communication with agitator 132. In this manner, drive assembly 138 may be configured for selectively rotating or oscillating wash basket 112 and/or agitator 132 during various operating cycles of laundry machine appliance 100.

More specifically, drive assembly 138 may generally include one or more of a drive motor 140 and a transmission assembly 142, e.g., such as a clutch assembly, for engaging and disengaging wash basket 112 and/or agitator 132. According to the illustrated embodiment, drive motor 140 is a brushless DC electric motor, e.g., a pancake motor. However, according to alternative embodiments, drive motor 140 may be any other suitable type of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Laundry appliance 100 may include one or more sensors or means for determining a laundry load size provided within wash basket 112. According to one example, a laundry load size or weight may be determined by driving drive motor 140 at a predetermined speed and detecting a basket speed and load output of drive motor 140. For instance, obtaining the basket speed of the wash basket may include measuring a motor frequency, a back electromotive force (EMF) on the motor, or a motor shaft speed (e.g., using a tachometer). It should be appreciated that other systems and methods for monitoring motor power and/or basket speeds may be used while remaining within the scope of the present subject matter.

Referring to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of laundry machine appliance 100 is controlled by a controller or processing device 156 that is communicatively coupled with control panel 150 for user manipulation to select washing machine cycles and features. In response to user manipulation of control panel 150, controller 156 operates the various components of laundry machine appliance 100 to execute selected machine cycles and features. Controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of laundry machine appliance 100 may be in communication with controller 156 via one or more signal lines or shared communication busses.

Referring to FIG. 3, laundry machine appliance 100 includes a water supply conduit 160 that provides fluid communication between a water supply source 162 (such as a municipal water supply) and a discharge nozzle 164 for directing a flow of water into tub 108, and more specifically, into wash chamber 114. In addition, laundry machine appliance 100 includes a water fill valve or water control valve 166 which is fluidly coupled with water supply conduit 160 and communicatively coupled to controller 156. In this manner, controller 156 may regulate the operation of water control valve 166 to regulate the amount of water within tub 108. Laundry appliance 100 may include a flow meter 172. Flow meter 172 may be connected to water supply conduit 160 to measure an amount of water added to tub 108. Flow meter 172 may send the detected water flow amount to controller 156. In addition, laundry machine appliance 100 may include one or more sensors 170 for detecting the amount of water and or clothes within tub 108. For example, sensor 170 may be operably coupled to a side of tub 108 for detecting the weight of tub 108. Additionally or alternatively, sensor 170 may detect and/or calculate a pressure of water within tub 108.

Sensor 170 may be a weight sensor, for example. Accordingly, sensor 170 may be provided as or include any suitable electronic load sensor or cell configured to generate one or more electronic signals according (e.g., in proportion to) a load thereon. For instance, sensor 170 may include a suitable strain gauge, force sensitive resistor, capacitance sensor, hydraulic sensor (e.g., having a deformable hydraulic tube), or pneumatic sensor (e.g., having a deformable pneumatic tube)—as would be understood.

Laundry appliance 100 may include a camera assembly configured to capture one or more images of an interior of wash basket 112. Controller 156 may be programmed or configured for analyzing the images obtained by the camera assembly, e.g., in order to determine the level or amount of a laundry load provided within wash chamber 114 or other cycle information, and may use this information to make informed decisions (e.g., regarding the operation of washing machine appliance 100 or regarding details of the laundry loads provided therein). For instance, the camera assembly may include one or more digital cameras capable of capturing still images, video images, or the like. The camera assembly may be attached to cabinet 102, door 120, or the like.

Figure 4:
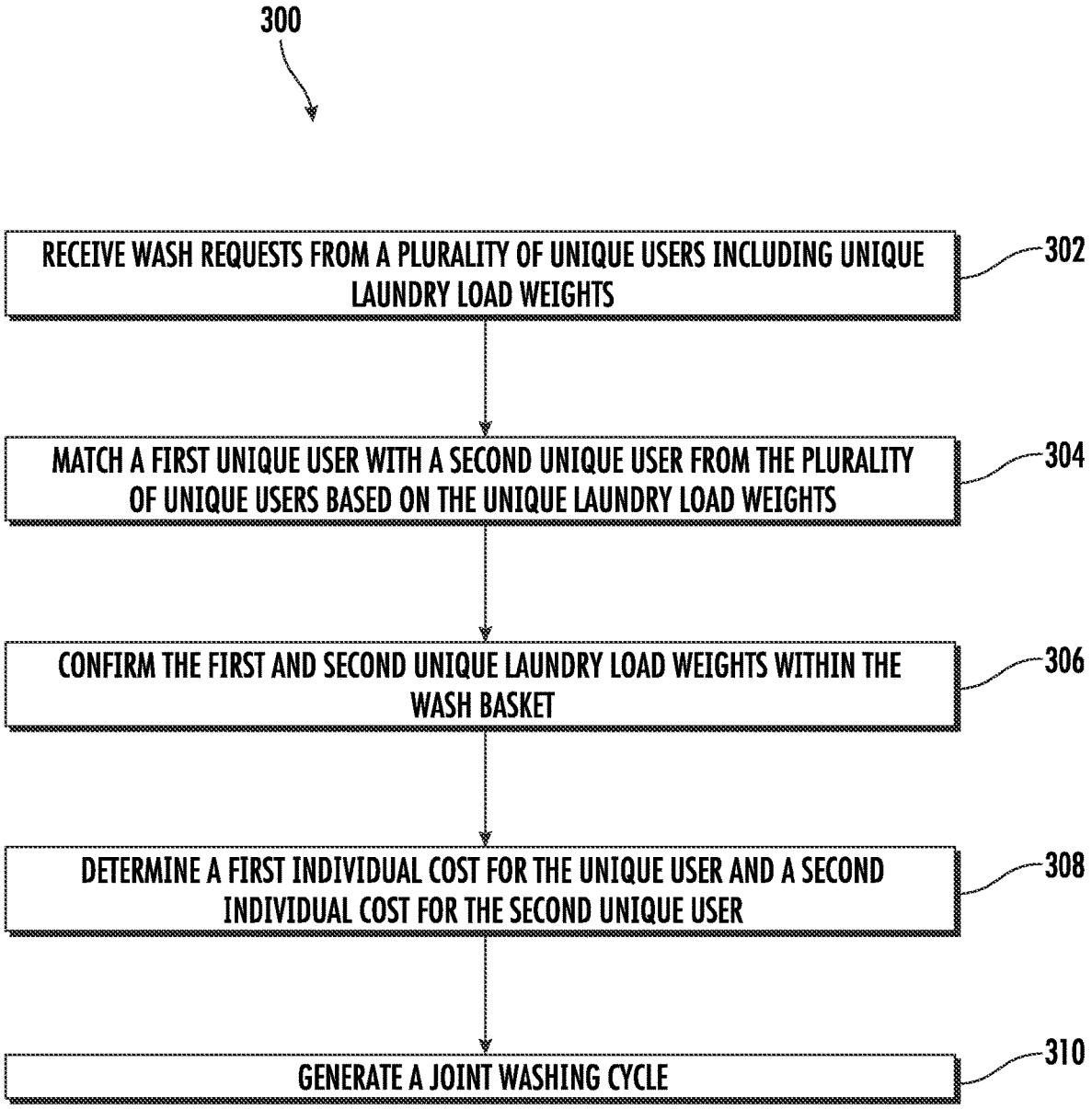
FIG. 4 provides a flow chart illustrating a method of operating a laundry machine appliance.

FIG. 4 provides a flowchart illustrating a method 300 of operating a laundry machine (e.g., laundry machine 100) according to an exemplary embodiment of the present disclosure. FIG. 4 provides a non-exhaustive method of operation, and the method may include more or fewer steps than shown in FIG. 4, according to specific embodiments.

At 302, method 300 may include receiving washing requests from a plurality of unique users, with each of the washing requests including a unique laundry load weight (e.g., as provided by each unique user). For instance, a plurality of unique users may each input a wash request through a mobile application on a mobile device, such as a mobile telephone. The wash requests may include one or more corresponding wash parameters, in addition to the unique laundry load weights. For instance, each unique user may independently weigh their unique laundry load at home (e.g., via a personal scale). As another example, each unique user may estimate the laundry load weight based on prior laundry experiences. Each of the plurality of users may utilize a mobile application (app) to input a unique wash request. The unique wash request may be received by a controller, for instance. The controller may be provided within the laundry appliance or may be located on a remote server.

As one example, a first unique user inputs a first wash request including a plurality of wash parameters. The first wash request may include a first unique laundry load weight. In detail, the first unique user may include an estimated weight of the first laundry load to be washed. The first unique laundry load weight may be provided as a pound-weight, a kilogram measurement, or the like. Similarly, a second unique user may input a second wash request including a plurality of wash parameters. The second wash request may include a second unique laundry load weight. The second unique laundry load weight may be different from the first unique laundry load weight. The second unique laundry load weight may be provided as a pound-weight, a kilogram measurement, or the like. It should be noted that any number of unique users may input wash requests, and the disclosure is not limited to the examples given herein.

The wash parameters may include a type of washing article (e.g., delicate, towel, sheet, etc.), a color of washing article (e.g., a generic white or assorted colors), a size of washing articles (e.g., bulky, oversized, etc.), a temperature of wash water, or the like. It should be noted that this list of potential wash parameters is not exhaustive, and additional parameters may be included. Additionally or alternatively, the corresponding wash parameters may include a date for performing a joint washing cycle, and a time of day for performing the joint washing cycle. The controller may then sort each wash cycle request and begin sorting certain laundry or wash requests together according to the corresponding wash parameters (e.g., users seeking a wash cycle for a load of delicates on a specified date). For instance, each of the first and second unique users may have at least one or more wash parameters in common between them. According to one example, the first unique user and the second unique user each input a wash request for a load of delicate laundry.

At step 304, method 300 may include matching the first unique user with the second unique user based on the unique laundry load weights. In detail, upon clumping similar users according to the corresponding wash parameters, the method 300 may include matching users with appropriate or balanced unique laundry load weights. Referring again to the above example, the first unique laundry load weight of the first unique user is compared with the second unique laundry load weight of the second unique user. For instance, the laundry appliance may combine or match two or more unique laundry weights that collectively add up to a certain percentage of a total laundry load weight limit of the laundry appliance, as will be described in more detail below.

Prior to matching the first unique user with the second unique user, the method 300 may include a pre-match sorting based on the wash parameters (e.g., complementary laundry load weights). For instance, the method 300 may determine that a combined laundry load weight (e.g., the first unique laundry load weight and the second unique laundry load weight added together) is less than a total weight capacity of the laundry treatment appliance. For instance, the method 300 may determine that the combined laundry load weight is between about 70% and about 90% of the total weight capacity of the laundry appliance. Notably, a buffer capacity of between about 10% and about 30% is left to account for inaccuracies in the first and/or second unique laundry load weights. Each of the first unique user and the second unique user may then set an appropriate date and time to meet to perform the joint washing cycle.

Additionally or alternatively, the method 300 may present the first or second unique user with a list of potential matches. For instance, two or more unique users having common wash parameters and complementary laundry load weights may be presented to the first or second unique user. The first or second unique user may then select a desired match with which to perform the joint washing cycle (e.g., a user with whom the first or second unique user had already matched previously). Thus, the first or second unique user may, via the mobile app, select the desired user with whom to perform the joint washing cycle. Moreover, unique users may establish connections according to successful operations. The controller may store this information and alert connected matches as to another connected match's desire to perform a joint washing cycle.

At step 306, method 300 may include confirming the first and second unique laundry load weights within the wash basket. In detail, the first and second unique users may meet at the selected laundry appliance to perform the joint washing cycle (e.g., at a laundromat). The first unique user may place their laundry load into the wash basket of the laundry appliance. The laundry appliance may then perform a weight sensing process to confirm the first unique laundry load weight. As described above, the weight sensing process may be executed in any suitable manner, such as utilizing an electronic weight sensor attached to the wash tub or wash basket, spinning the wash basket at a predetermined rotational speed and determining a load on the drive motor, capturing an image of the laundry load and performing an image analysis, or the like. The method 300 may then include storing the confirmed first unique laundry load weight (e.g., within a memory).

Subsequently, the second unique user may place their laundry load into the wash basket of the laundry appliance. The laundry appliance may again perform the weight sensing process. At this point, the laundry appliance may determine the total or combined laundry load weight within the wash basket (e.g., the weight of each of the first laundry load and the second laundry load). Upon determining the combined laundry load weight, the method 300 may include subtracting the confirmed first unique laundry load weight from the combined laundry load weight. Accordingly, the second unique laundry load weight may be confirmed as the difference between the combined laundry load weight and the confirmed first unique laundry load weight. It should be understood that additional laundry loads may be added into the combined weight, with a similar procedure performed to confirm each unique laundry load weight.

At step 308, method 300 may include determining a first individual cost for the first unique user and a second individual cost for the second unique user. In detail, upon confirming the first unique laundry load weight of the first unique user and the second unique laundry load weight of the second unique user, the controller may split a total cost of performing the joint washing cycle between the first and second unique users. Further to the example given above, the total cost split between the first and second users may be determined according to the individual unique laundry load weights of each unique user. According to one example, the first unique laundry load weight of the first unique user is larger than the second unique laundry load weight of the second unique user. Accordingly, the first unique user, having the larger laundry load weight, would be obligated to pay a larger portion of the total cost compared to the second unique user, having the smaller laundry load weight. In at least one embodiment, the first unique user would be assigned a cost that is between about 60% and about 70% of the total cost of the joint washing cycle. Accordingly, the remaining portion would be assigned to the second unique user. Advantageously, each user may pay a fair share of the total laundry cost according to the amount of laundry included within the joint washing cycle.

The controller may accept payments from each of the first unique user and the second unique user remotely. For instance, a mobile application provided on the mobile device of each unique user may include a virtual payment option. The mobile application may be remotely connected with the laundry appliance. Accordingly, each individual payment from each unique user may be supplied to the laundry appliance together. It should be noted that additional or alternative payment methods may be accepted, such as an on-board cash payment receiver, a credit card receiver, or the like.

The controller may further determine a total amount of water to be used during the joint washing cycle. In determining the total amount of water to be used, the controller may consider one or more of the wash parameters input by the plurality of unique users (e.g., the first and second unique users). For instance, a total combined laundry load weight (and thus a total volume of washing articles) together with a selected cycle or operation (heavy soil, delicates, bulky, etc.) may determine a total amount of water to be used in the joint washing operation.

The method 300 may include receiving confirmation from each of the first and second unique users. In detail, upon determining the associated individual costs for each unique user, the controller may notify each user of the selected and/or determined options. In at least some embodiments, the laundry appliance sends a notification to each unique user (e.g., via mobile communication). The notification may include all of the determined factors together with a request to confirm the joint washing cycle. Accordingly, each unique user may confirm the scheduled joint washing cycle. For instance, each user may press a button (e.g., on a touch-screen of a connected mobile device) indicating that the joint washing cycle has been confirmed.

At step 310, method 300 may include generating the joint washing operation in accordance with the set of washing parameters. In response to receiving the confirmation from each of the first unique user and the second unique user, the controller may generate the joint washing operation, including the wash parameters input and/or determined. The joint washing operation may include the total amount of water to be used, a number of cycles to perform (e.g., fill cycles, agitation cycles, drain cycles, rinse cycles, spin cycles, etc.). The joint washing operation may then be stored, for instance, within the controller. In at least some embodiments, the joint washing operation is stored within the controller on board the washing machine.

The method 300 may include initiating the joint washing cycle. For instance, upon confirming the combined laundry load weight, confirming each individual cost, receiving confirmation from each of the first and second unique users, and receiving payment, the laundry appliance may initiate the joint washing cycle according to the wash parameters. Additionally or alternatively, the combined laundry load may have a subsequent joint laundry cycle performed thereto (e.g., a drying cycle). For instance, each of the first and second unique users may be notified of the completion of the joint washing cycle. The first and second unique users may then agree to a subsequent joint drying cycle. According to at least one embodiment, the combined laundry load is moved to a separate laundry appliance (e.g., a dryer), where the previously confirmed unique laundry load weights may be retrieved. Accordingly, individual costs for the joint drying cycle may be calculated using the previously confirmed unique laundry load weights.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry treatment appliance defining a vertical direction, a lateral direction, and a transverse direction, the laundry treatment appliance comprising:

a cabinet defining a receiving space;

a wash tub provided within the receiving space;

a wash basket received within the wash tub; and a controller provided within the cabinet, the controller being configured to direct a laundry operation, the laundry operation comprising:

receiving wash requests from a plurality of unique users, wherein each of the wash requests comprises a unique laundry load weight provided by each unique user of the plurality of unique users;

matching a first unique user and a second unique user from the plurality of users, the first user having a first unique laundry load weight and the second user having a second unique laundry load weight;

confirming the first and second unique laundry load weights within the wash basket;

determining a first individual cost for the first unique user and a second individual cost for the second unique user in response to confirming the first and second unique laundry load weights; and generating a joint washing cycle subsequent to confirming the first and second laundry load weights.

2. The laundry treatment appliance of claim 1, wherein each of the wash requests comprises one or more wash parameters, and wherein matching the first unique user and the second unique user comprises:

determining that at least one of the one or more wash parameters is in common between the first unique user and the second unique user.

3. The laundry treatment appliance of claim 2, wherein the one or more wash parameters comprise a color of laundry load, a temperature of water for the joint washing cycle, or a date for performing the joint washing cycle.

4. The laundry treatment appliance of claim 1, wherein matching the first unique user and the second unique user from the plurality of users according to the unique laundry load weights comprises determining a combined laundry load weight corresponding to the first unique laundry load weight and the second unique laundry weight, the combined laundry load weight being less than a total weight capacity of the laundry treatment appliance.

5. The laundry treatment appliance of claim 4, wherein the combined laundry load weight is between 70% and 90% of the total weight capacity of the laundry treatment appliance.

6. The laundry treatment appliance of claim 1, wherein confirming the first and second unique laundry load weights within the wash basket comprises:

receiving a first laundry load within the wash basket, the first laundry load having the first unique laundry load weight;

confirming the first unique laundry load weight via a weight sensor provided within the laundry treatment appliance;

receiving a second laundry load within the wash basket subsequent to confirming the first unique laundry load weight, the second laundry load having the second unique laundry load weight; and confirming the second unique laundry load weight via the weight sensor.

7. The laundry treatment appliance of claim 6, wherein the weight sensor is a pressure sensor attached to the wash tub.

8. The laundry treatment appliance of claim 6, further comprising:

a motor operably coupled to the wash basket to selectively rotate the wash basket within the wash tub, wherein the weight sensor comprises an accelerometer attached to the motor.

9. The laundry treatment appliance of claim 6, wherein the laundry operation further comprises:

confirming a combined laundry load weight within the wash basket after receiving each of the first and second laundry loads within the wash basket; and determining a total cost for the joint washing cycle in response to confirming the combined laundry load weight within the wash basket.

10. The laundry treatment appliance of claim 9, wherein the laundry operation further comprises:

determining the first individual cost for the first unique user and the second individual cost for the second unique user after determining the total cost of the joint washing cycle;

receiving a confirmation from each of the first and second unique users; and initiating the joint washing cycle in response to receiving the confirmation from each of the first and second unique users.

11. A method of operating a laundry treatment appliance, the laundry treatment appliance comprising a cabinet defining a receiving space, a wash tub provided within the receiving space, a wash basket received within the wash tub, and a controller provided within the cabinet, the controller being configured to direct the method of operating the laundry treatment appliance, the method comprising:

receiving wash requests from a plurality of unique users, wherein each of the wash requests comprises a unique laundry load weight provided by each unique user of the plurality of unique users;

matching a first unique user and a second unique user from the plurality of users, the first user having a first unique laundry load weight and the second user having a second unique laundry load weight;

confirming the first and second unique laundry load weights within the wash basket;

determining a first individual cost for the first unique user and a second individual cost for the second unique user in response to confirming the first and second unique laundry load weights; and generating a joint washing cycle subsequent to confirming the first and second laundry load weights.

12. The method of claim 11, wherein each of the wash requests comprises one or more wash parameters, and wherein matching the first unique user and the second unique user comprises:

determining that at least one of the one or more wash parameters is in common between the first unique user and the second unique user.

13. The method of claim 12, wherein the one or more wash parameters comprise a color of laundry load, a temperature of water for the joint washing cycle, or a date for performing the joint washing cycle.

14. The method of claim 11, wherein matching the first unique user and the second unique user from the plurality of users according to the unique laundry load weights comprises determining a combined laundry load weight corresponding to the first unique laundry load weight and the second unique laundry load weight, the combined laundry load weight being less than a total weight capacity of the laundry treatment appliance.

15. The method of claim 14, wherein the combined laundry load weight is between 70% and 90% of the total weight capacity of the laundry treatment appliance.

16. The method of claim 11, wherein confirming the first and second unique laundry load weights within the wash basket comprises:

receiving a first laundry load within the wash basket, the first laundry load having the first unique laundry load weight;

confirming the first unique laundry load weight via a weight sensor provided within the laundry treatment appliance;

receiving a second laundry load within the wash basket subsequent to confirming the first unique laundry load weight, the second laundry load having the second unique laundry load weight; and confirming the second unique laundry load weight via the weight sensor.

17. The method of claim 16, wherein the weight sensor is a pressure sensor attached to the wash tub.

18. The method of claim 16, wherein the laundry treatment appliance further comprises:

a motor operably coupled to the wash basket to selectively rotate the wash basket within the wash tub, wherein the weight sensor comprises an accelerometer attached to the motor.

19. The method of claim 16, further comprising:

confirming a combined laundry load weight within the wash basket after receiving each of the first and second laundry loads within the wash basket; and determining a total cost for the joint washing cycle in response to confirming the combined laundry load weight within the wash basket.

20. The method of claim 19, further comprising:

determining the first individual cost for the first unique user and the second unique cost for the second unique user after determining the total cost of the joint washing cycle;

receiving a confirmation from each of the first and second unique users; and initiating the joint washing cycle in response to receiving the confirmation from each of the first and second unique users.

* * * * *